United States Patent [19]

Barrat et al.

[11] Patent Number: 4,639,321

[45] Date of Patent: Jan. 27, 1987

[54] LIQUID DETERGENT COMPOSITIONS CONTAINING ORGANO-FUNCTIONAL POLYSILOXANES

[75] Inventors: Christian R. Barrat, Brussels; Alfred Busch, Strombeek-Bever, both of Belgium; Kosmas Sardelis, Athens, Greece

[73] Assignee: The Procter and Gamble Company, Cincinnati, Ohio

[21] Appl. No.: 693,322

[22] Filed: Jan. 22, 1985

[51] Int. Cl.[4] ..... D06M 11/00

[52] U.S. Cl. ..... 252/8.8; 252/8.9; 252/174.15; 252/546; 524/262

[58] Field of Search ..... 252/8.8, 8.9, 174.15, 252/544, 546, 547; 524/262

[56] References Cited

U.S. PATENT DOCUMENTS

| | | | |
|---|---|---|---|
| 3,933,672 | 1/1976 | Bartolotta et al. | 252/174 |
| 4,075,118 | 2/1978 | Gautt et al. | 252/89 |
| 4,247,592 | 1/1981 | Kalinowski | 428/266 |
| 4,359,545 | 11/1982 | Ona et al. | 252/8.8 |

FOREIGN PATENT DOCUMENTS

| | | |
|---|---|---|
| 131096 | 3/1978 | Japan . |
| 1296136 | 11/1972 | United Kingdom . |
| 1549180 | 7/1979 | United Kingdom . |

*Primary Examiner*—Paul Lieberman
*Assistant Examiner*—Willie J. Thompson
*Attorney, Agent, or Firm*—Robert B. Aylor; Richard C. Witte; Thomas H. O'Flaherty

[57] ABSTRACT

Liquid detergent compositions containing additive levels of organo-functional polysiloxanes are disclosed. The siloxanes are derived from poly-di-short-alkyl siloxanes by substituting part of the alkyl moieties by specific organo-functional groups, preferably amino-groups, with the proviso that the degree of substitution is in the range from 0.01–0.7. The liquid compositions herein unexpectedly provide through-the-wash softening benefits comparable to what can be obtained from the utilization of conventional cationic rinse-softeners.

15 Claims, No Drawings

LIQUID DETERGENT COMPOSITIONS CONTAINING ORGANO-FUNCTIONAL POLYSILOXANES

This invention relates to liquid detergent compositions containing low levels of selected organo-functional polydi-alkylsiloxanes. In more detail, the compositions herein comprise conventional ingredients inclusive of surface-active agents, liquid carrier and optional ingredients such as detergent builders, enzymes and suds regulants and low levels of organo-functional polydi-short alkylsiloxanes. The latter ingredient unexpectedly provides desirable through-the-wash textile benefits inclusive of softness. The preferred siloxanes embrace amino derivatives. The essential siloxanes are further characterized by a degree of substitution in the range from 0.01–0.7.

The through-the-wash textile benefits conferred by the inventive compositions, in addition to softening, are frequently perceived in terms of anti-static, ease-of-ironing and anti-wrinkling benefits. On a conservative basis, it was established that, at least, and contrary to standing prejudice, the essential siloxane components do not, adversely affect the general textile cleaning suitability of the compositions herein. The liquid compositions herein can be divided arbitrarily in (mostly P-)-built compositions and in substantially unbuilt compositions. Both kinds of compositions will procure textile handling benefits. Selective preference can originate from the combined use of anionic surface-active agents in combination with the subject siloxanes.

The prior art relative to the textile-treatment utilization broadly of silicones/polydialkylsiloxanes is crowded and diverse. The like siloxanes have, for example, found widespread commercial application in a detergent suds regulant functionality. Silicone polymers have also found widespread application in the textile industry to provide fiber properties inclusive of softness, water proofing and easy ironing. To that effect the silicone polymers are applied (in the textile industry) to the fabrics during manufacture or during make-up of clothing, in the form of relatively concentrated dispersions or solutions either by padding or spray-on. Often, especially for long lasting softness, water proofing treatment or other benefits, mixtures or organofunctioual polydialkylsiloxanes are used. The fabrics are subsequently treated with catalysts or heated to cause cross-linking or setting of the silicone polymers.

German Patent No. 27 54 504 and U.S. Pat. No. 4,247,592 disclose a treating agent consisting of a polydimethylsiloxane containing diaminoalkyl groups for providing softness to natural and synthetic fabrics.

Japanese Patent No. 79,131,096 pertains to a treating agent consisting of a mixture of polydimethylsiloxane with NHR-groups and a polydimethylsiloxane with hydroxy end groups, for providing softness to acrylics. The fabrics are spray coated and then heated for curing.

German Patent No. 20 16 095 uses polydimethylsiloxane containing pendant epoxy groups for providing softness and smoothness to synthetic organic fabrics.

European Patent No. 058 493 relates to a treating agent mixture of an organo polysiloxane containing diaminoalkyl and polyoxyalkylene groups, with an organopolysiloxane containing carboxylic acid ester groups or with an organopolysiloxane containing epoxy and polyoxyalkylene groups. The mixture is added by spray-on and treated for curing. It is said to provide softness, anti-wrinkling and long lasting electrostatic prevention benefits.

German Patent application No. DOS 26.31.419 relates to fabric rinse softening compositions containing a fabric-substantive cationic domponent and a polydimethylsiloxane possibly amino substituted. The mixture is applied as an aqueous dispersion.

The suds regulant utilization of polydimethylsiloxanes in liquid detergent is known from European Patent application No. 0.028.865. U.S. Pat. No. 4,075,118 discloses the utilization of emulsified polydimethylsilicones for suds regulant purposes.

The feasibility for using polydimethylsilicones in granular detergents for foam control is known from DOS No. 23.38.468.

It is also known that the detergent incorporation of polydimethylsiloxane suds regulants can adversely affect textile cleaning benefits.

It has now been found that specific organo-functional polydialkylsiloxanes, preferably aminosubstituted species, can advantageously be incorporated in liquid detergents generally to provide remarkable benefits inclusive of through-the-wash softening and further textile handling improvements. The essential means needed to achieve these unexpected properties are explained in more detail hereafter.

SUMMARY OF THE INVENTION

This invention is based on the discovery that liquid detergent compositions capable of simultaneously providing fiber-cleaning and textile handling benefits, inclusive of softness, can now be formulated containing a binary component systems and an organo-functional siloxane.

In particular, the compositions herein comprise:

(a) from 5% to 70% by weight of a surface-active agent selected from the group of anionic, nonionic, ampholytic and zwitterionic- surface-active agents and mixtures thereof;

(b) a liquid carrier; and (c) if desired, conventional detergent additives inclusive of detergent builders, enzymes and suds regulants, characterized in, that it contains:

(d) from 0.05% to 5% by weight of an organo-functional poly-di-$C_{1-4}$-alkyl siloxane textile treatment agent having the general formula :

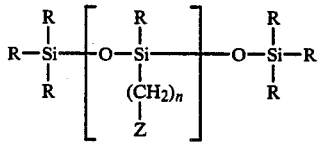

wherein

R=$C_{1-4}$-alkyl; n is an integer from 1 to 6;

Z is

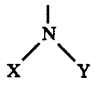

whereby X and Y are, selected independently, —H; —$C_{1-30}$-alkyl; —$C_6$-aryl; —$C_{5-6}$-cycloalkyl; —$C_{1-6}$—$NH_2$;—CO—R; with the proviso that the nitrogen can be quaternized such as to represent

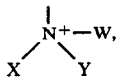

whereby W can be selected from X or Y or

Z is

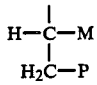

whereby P and M are —COOH; —CO—NR'2; or —CO—OR' and wherein R' is hydrogen or $C_{1-2}$alkyl with the further proviso that the degree of substitution, i.e., the molar proportion of silicones carrying a substituent other than $C_{1-14}$alkyl group to total silicones is in the range from 0.01 to 0.7. Especially preferred are aminosubstituted siloxanes having a degree of substitution in the range from 0.05 to 0.5.

In one preferred execution herein the substituted siloxanes are incorporated in liquid detergent compositions containing inorganic builder salts such as (poly)-phosphates.

In another preferred composition aspect of the invention, the siloxanes are incorporated in concentrated liquid compositions which are substantially free of builders.

DETAILED DESCRIPTION OF THE INVENTION

The invention herein broadly relates to liquid detergent compositions comprising a surface-active agent, a liquid carrier, an organo-functional polydi-alkylsiloxane textile treatment agent, and, if desirable, conventional detergent additives. These variables and other aspects of the invention are explained in more detail hereinafter.

Unless indicated to the contrary, the "percent"indications stand for "percent by weight".

THE SURFACE-ACTIVE AGENT

A first essential component for use in the compositions of this invention is represented by a surface-active agent selected from the group of anionic, nonionic, amphoteric (ampholytic) and zwitterionic surface-active agents and mixtures thereof. In the context of this invention, the term nonionic surface-active agent is meant to include semi-polar nonionic surfactants.

Examples of suitable non-ionic surfactants are disclosed in E.P.A No. 0.028.865 page 4, line 23 to page 5, line 10 and page 8 line 14 to page 9, line 4, said disclosures being incorporated herein by reference.

A disclosure of zwitterionic and ampholytic surfactants for use herein can also be found in E.P.A No. 0.028.865 page 7, line 21 to page 8, line 13, this passage being also incorporated herein by reference.

The anionic surfactants for use herein can be represented by known synthetic and natural anionic surface-active agents which are known to be suitable for use in detergents and frequently have found commercial application. Suitable synthetic anionic surfactants are described in E.P.A No. 0.028.865 page 5, line 12 to line 31.

Examples of natural anionic surface-active agents for use in this invention can be represented by saturated and unsaturated fatty acids having from 10 to 20 carbon atoms in the alkyl chain or the alkali-metal, earth-alkali-metal and amine or alkanolamine soaps thereof. Preferred fatty acids/soaps have from 12 to 18 carbon atoms in the alkyl chain. Well-known examples of fatty acids/soaps suitable for use herein are natural coconut fatty acid containing a majority of $C_{12}$ and $C_{14}$ acids and tallow fatty acids containing a mixture of saturated and unsaturated $C_{16}$ and $C_{18}$-fatty acids/soaps.

The surface -active agent is used generally at levels from 5% to 70%. While the surface-active agent may be varied over the broad range depending upon the intended utility of the composition and the quantitative and qualitative definition of the additional ingredients and possibly optional components, two preferred executions can be formulated depending upon the presence of (poly)-phosphate builders.

In a first preferred execution of the invention liquid compositions are envisaged which are substantially unbuilt. In this embodiment, the surface active agents are frequently used in an amount from 25% to 55% and are represented by a mixture of anionic and nonionic surface-active agents, more preferably in a weight ratio of anionic to nonionic in the range from 4:1 to 1:4.

In a second preferred embodiment, liquid built detergent compositions are contemplated containing from 5% to 25%, preferably from 5% to 15% surface-active agent. The latter ingredient can preferably be represented by a mixture of anionic and nonionic surface-active agents whereby the anionic species represents at least 20% of the sum of anionic and nonionic surface-active agents, and at least 3%, calculated on the detergent composition.

The like detergent compositions frequently comprise from 5% to 30%, preferably from 12% to 25% of a detergent builder which can be represented by conventional detergent builders many of which have already found commercial application. Well-known examples of suitable builders include the alkali, often sodium, metal salts of (poly)phosphates, e.g. tripolyphosphoric acid, nitrilotriacetic acid (NTA), citric acid and crystalline, completely hydrated, synthetically prepared zeolite builders having a particle diameter in the range from 0.1 to 10, preferably from 0.1 to 4 micrometers. Suitable zeolite builders are ZEOLITE A, X and P. Mixtures of detergent builders can also be used.

The compositions herein can additionally contain, as an optional ingredient, a cationic surfactant. Suitable cationic surfactant species for use herein are described in European Patent application No. 0.028.865, page 5, line 32 to page 7 line 21, this passage being incorporated herein by reference. The cationic surfactants can provide and/or enhance a broad range of textile treatment benefits inclusive of cleaning, feel, and bactericidal advantages. These optional cationic surface-active agents are used in additive levels, such as in levels not exceeding 10% of the cumulative amount of anionic and nonionic surfactants defined hereinbefore, and more preferred in a range from 1% to 5% of the detergent composition.

THE-LIQUID CARRIER

The compositions herein contain as a further essential component a liquid carrier, possibly a mixture of liquid carriers. The liquid carrier component can be represented by water and conventional liquid organic carriers. Non-limiting examples of the like organic carriers include lower aliphatic alcohol having from 2 to about 6 carbon atoms and 1 to 3 hydroxyl groups; ethers of diethylene glycol and lower aliphatic mono-alcohols having from 1 to 4 carbon atoms and mixtures thereof.

Specific examples of liquid carriers are: ethanol; n-propanol; isopropanol; butanol; 1,2-propanediol; 1,3-propanediol; n-hexanol; monomethyl-, -ethyl-, -propyl, and mono-butyl ethers and di-ethylene glycol. Other organic solvents having a relatively high boiling point and low vapor pressure can also be used, provided they do not react with any of the other ingredients present. The relative quantities of liquid carriers needed to insure the liquid state of the composition can vary depending upon the qualitative and quantitative ingredient parameters in a given composition. However, the adequate choice of the carrier is based on routine determinations well-known in the art.

THE ORGANO-FUNCTIONAL SILOXANE

The essential organo-functional siloxane for use herein can be present in levels from 0.05% to 5%, preferably from 0.1–3%, and most preferably from 0.15–1%. Using levels below 0.05% will not anymore produce, to any noticeable extent, the claimed benefits whereas the incorporation of levels exceeding 5% will not produce additional benefits commensurate with (proportional to) the level increase.

The organo-functional-polydi-$C_{1-4}$-alkyl siloxane component can stoichiometrically be defined with the aid of the following formula:

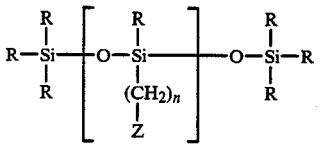

wherein wherein R=$C_{1-4}$ -alkyl; n is an integer from 1 to 6; Z is

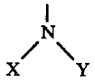

whereby X and Y are, selected independently, —H; —$C_{1-30}$-alkyl; —$C_6$-aryl; —$C_{5-6}$-cycloalkyl; —$C_{1-6}$—$NH_2$; —CO— R; with the proviso tha the nitrogen can be quaternized such as to represent

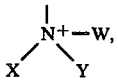

whereby W can be selected from X and Y or Z is

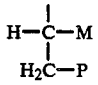

whereby P and M are —COOH; —CO— NR'$_2$; or —CO— OR' and wherein R' is hydrogen or $C_{1-2}$-alkyl;

with the proviso that the degree of substitution, i.e. the molar proportion of silicones carrying a substituent other than a $C_{1-4}$alkyl group to total silicones is in the range from 0.01 to 0.7, preferably from 0.02–0.3.

The siloxane component is preferably represented by amino-functional polydialkylsiloxanes which are frequently used in levels from 0.1% to 3%, more preferably from 0.15–1.0%.

The degree of substitution of preferred siloxanes, such as the aminosiloxanes, can be expressed as the molar (moiety) proportion of non-terminal silicones carrying a substituent other than a $C_{1-4}$ alkyl group to total non-terminal silicones. The numerical value for the degree of substitution of preferred siloxanes lies in the range from 0.01 to 0.7; preferably from 0.02 to 0.3. While non-terminal substitution is preferred for enhanced through-the-wash fiber substantivity, it is understood that siloxanes with substituted terminal silicone atoms can also be used.

In the preferred siloxane component herein, n is 3 or 4, X and Y are, selected independently, hydrogen; —$C_{1-4}$-alkyl; —$C_{5-6}$—cycloalkyl and —$C_2$—$NH_2$.

Preferred organofunctional polydimethyl siloxanes include aminofunctional siloxanes, such as:

| | Abbreviated |
|---|---|
| (N—cyclohexylamino-4 amino-butyl-1) polydimethylsiloxane | Sil-I |
| (Ethylene diamino-N—butyl-1)polydimethyl-siloxane | Sil-II |
| (N—dodecyl-4 amino-butyl-1)polydimethylsiloxane | Sil-III |
| (4-(N,N—dimethyl ammonium)-butyl-1) polydimethylsiloxane | Sil-IV |
| (5(tallow amide)-4-carboxy-pentyl-1) polydimethylsiloxane | Sil-V |

The organofunctional siloxanes have generally a viscosity in the range from 40 cSt to 100.000 cSt, preferably from 250 cSt to 2000 cSt. The viscosity of the siloxanes is measured on the pure raw material at 25° C. with the aid of a BROOKFIELD ® viscometer (LV Digital).

The organofunctional polydimethyl siloxanes, in addition to the essential substituents defined hereinbefore, can contain polyalkylene oxide chains attached to unsubstituted silicone atoms (in the meaning of this invention). The polyalkylene, such as propylene or ethylene, oxide chains are attached to the silicone atoms instead of a $C_{1-4}$ alkyl group. The alkoxylation enhances the hydrophilic and antistatic (charge-reducing) properties of the component in relation to the textiles.

OPTIONAL INGREDIENTS

In addition to the essential components, the compositions herein can contain a series of optional detergent ingredients with a view to improve the composition taking into consideration the specific utilization. These optional components can be presented by virtually all substances, which are known to suitable for use in the like composition, for their known functionality in the art established levels.

The non-built or built compositions of the invention can contain, in addition to the detergent builder, other types of sequestrants, having precipitation inhibitor or anti-incrustation properties, in varying levels e.g. in an amount from 0.2% to 5%. Such further sequestrants can be water-soluble copolymeric ingredients e.g. : polyacrylates, polymaleates and copolymeric carboxylates including those obtained from the copolymerization of unsaturated polyacids such a maleic or citraconic acid with suitable polymerizable reaction partners such as methacrylic acid, acrylic acid, mesaconic acid and methyl-vinyl-ether. Mixture of the like watersoluble detergent sequestrant can also be used.

Examples of other optional components are detergent enzymes such as proteases, amylases, lipases and mixtures thereof, and stabilizing agents for the like enzymes., soil suspending agents such as sodium carboxymethylcellulose and polyvinylpyrrolidone, suds regulants, such as $C_{16-22}$ fatty acids and methylated polysiloxanes, especially dimethylpolysiloxane, said silicone being used preferably at levels from 0.01% to 0.4%.

Hydrotropes can also be used and are frequently desirable in built compositions. Examples of suitable hydrotropes include the water-soluble alkylaryl sulfonates having up to 3 carbon atoms in an alkyl group such as sodium, potassium, ammonium, and ethanol amine salts of xylene-, toluene-, ethylbenzene- and isopropyl benzene sulfonic acids.

The subject compositions further can comprise brighteners, perfumes, dyes, bactericidal agents, antioxidants, opacifiers, photoactivators, fillers and the like.

EXAMPLES

The following examples illustrate preferred executions of this invention, and facilitate its understanding. The abbreviations for the individual ingredients of the examples have the following meaning:

LAS: Sodium salt of linear dodecyl benzene sulfonate.
HLAS: Linear dodecylbenzene sulfonic acid.
TEACnAS: Triethanolamine coconut ($C_{12-14}$) alcohol sulfate.
$C_{x-y}EO_n$: $C_{x-y}$ alcohol ethoxylated with n moles of ethylene oxide.
DTPA: Sodium salt of diethylene triamine penta acetic acid.
DETPMP: Diethylene triamine pentamethyl phosphonic acid.
$C_{12}$TMAC: Dodecyl trimethyl ammonium chloride.
$C_{x-y}(EO)_nS$: Sodium salt of $C_{x-y}$ alcohol ethoxylated with n moles of ethylene oxide and sulfated.
DTMAC: Ditallow dimethyl ammonium chloride.
TEPA-EO: Tetraethylene pentamine ethoxylated with about 100 moles of ethylene oxide.
KTS: Potassium salt of toluene sulfonate.
STPP: Sodium tripolyphosphate.
NTA: Sodium salt of nitrilo-triacetic acid.
CnDEA: Coconut diethanol amide.

The following liquid detergent compositions were prepared by mixing, in a conventional manner, the following ingredients in the stated proportions; the aminofunctional polysiloxane was admixed directly in liquid composition under agitation.

| COMPOSITIONS (% BY WEIGHT) | Comp. A | Ex I | Comp. B | Ex II |
|---|---|---|---|---|
| LAS | 11.3 | 11.3 | 6.3 | 6.3 |
| TEACnAS | 4.0 | 4.0 | — | — |
| $C_{13-15}$ EO7 | 12.0 | 12.0 | 3.7 | 3.7 |
| $C_{12-14}$ Fatty Acid | 10.0 | 10.0 | — | — |
| Oleic Acid | 5.0 | 5.0 | — | — |
| $C_{16-20}$ Fatty Acid | — | — | 1.1 | 1.1 |

-continued

| COMPOSITIONS (% BY WEIGHT) | Comp. A | Ex I | Comp. B | Ex II |
|---|---|---|---|---|
| STPP | — | — | 23.0 | 23.0 |
| DETPMP | 0.6 | 0.6 | — | — |
| Ethanol | 8.6 | 8.6 | — | — |
| Propanediol | 3.0 | 3.0 | — | — |
| Glycerol | — | — | 4.8 | 4.8 |
| Sodium borate | — | — | 2 | 2 |
| Sil-I (1) | — | 2.0 | — | 2.0 |
| Sodium hydroxyde to adjust pH (2) to | 7.7 | 7.7 | 7.3 | 7.3 |
| Miscellaneous (brighteners, dyes, enzymes, perfumes, water) | balance to 100 | | | |

(1) Degree of substitution of 0.15; viscosity 300 centistokes.
(2) pH in composition.

The composition of examples I and II were compared for through-the-wash softness versus identical compositions A and B which did not contain the aminofunctional polydimethylsiloxane.

The testing conditions were as follows:
automatic drum washing machine MIELE 423.
one wash cycle, heating up to 60° C., mainwash only.
3 kg cotton load+test terry swatches.
1% product concentration in wash liquor.
0.308 g/l water hardness ($CaCO_3$ basis).

The washed and line dried terry swatches were compared by a panel of two expert judges, working independently, by a paired comparison technique using a 9-point Scheffe scale. Differences were recorded in panel score units (psu), positive being performancewise better and the least significant difference (LSD) at 95% confidence was also calculated.

The testing results were as follows:

| SOFTNESS (psu) | | | |
|---|---|---|---|
| Example I | versus | Comp. A | LSD |
| +0.3 | | −0.3 | 0.5 |
| Example II | versus | Comp. B | LSD |
| +0.5 | | −0.5 | 0.5 |

These results show the significant softness through-the-wash benefits derivable from inventive compositions of examples I and II versus identical compositions A and B which did not contain the aminofunctional polydimethylsiloxane.

Comparable textile benefits can be secured from liquid detergent compositions I and II hereinabove wherein the (N-cyclohexyl-4-amino-butyl-1) polydimethylsiloxane (Sil-I) is replaced by the listed organofunctional siloxanes in the stated proportions.

| SILOXANE | DEGREE OF SUBSTITUTION | EXAMPLE I | EXAMPLE II |
|---|---|---|---|
| Sil-II | 0.18 | 1.0 | — |
| Sil-II | 0.45 | — | 0.7 |
| Sil-III | 0.08 | 0.3 | 1.3 |
| Sil-III | 0.20 | — | 0.5 |
| Sil-IV | 0.25 | 0.6 | 1.4 |
| Sil-IV | 0.60 | 0.9 | 0.2 |
| Sil-V | 0.05 | 0.4 | — |
| Sil-V | 0.30 | 0.2 | 1.2 |

Further examples of substantially unbuilt compositions in accordance with the invention are as follows:

| INGREDIENT | EXAMPLES (% BY WEIGHT) III | IV | V | VI | VII | VIII | IX |
|---|---|---|---|---|---|---|---|
| HLAS | 10 | 7 | 7 | — | — | — | — |
| $C_{14-15}.EO_2.S$ | — | 12 | 12 | 11.5 | — | — | — |
| $C_{12-14}.EO.S$ | — | — | — | — | — | 9.4 | — |
| $C_{12-13}.EO_{6.5}$ | — | — | — | — | — | 21.5 | — |
| $C_{14-15}.EO7$ | — | — | — | — | — | — | 18 |
| Coconut alkyl dimethylamine oxide | — | — | — | — | — | — | 1 |
| TEA.CnAS | 4 | — | — | — | — | — | — |
| $C_{13-15}.EO7$ | 12 | 7 | 7 | 22 | 23 | — | — |
| $C_{12}.TMAC$ | — | 1.1 | — | — | — | — | — |
| DTMAC | — | — | — | — | 5 | — | 3 |
| $C_{12-14}$.Fatty Acid | 10 | 13 | 15 | — | — | — | — |
| Oleic Acid | 5 | 2 | — | — | — | — | — |
| Sodium Citrate | 2.5 | 5 | 5 | 0.1 | — | — | — |
| DETPMP | 0.6 | — | — | — | — | — | — |
| DTPA | — | 0.3 | 0.6 | — | — | 0.2 | — |
| Proteolytic enzyme | 0.7 | 0.7 | 0.7 | 0.7 | — | 0.6 | 0.6 |
| Amylase | 0.1 | 0.2 | 0.2 | — | — | 0.2 | 0.2 |
| Ethanol | 5 | 8 | 7 | 10 | 15 | 5.7 | 7.5 |
| Propanediol, 1-2 | 4 | 7 | 4 | — | — | — | — |
| TEPA.EO | 1.5 | 1.5 | 1.0 | — | — | — | 1.5 |
| Sil-I - DS(*): 0.15 | 0.8 | — | 0.4 | — | 0.5 | — | 0.6 |
| Sil-II - DS: 0.33 | — | 0.3 | — | 0.7 | — | 0.7 | — |
| Miscellaneous incl. of water, brightener, neutralizing agents, aesthetics | | | balance to 100 | | | | |

(*)DS = degree of substitution.

Examples of built compositions in accordance with this invention are as follows:

| INGREDIENT | EXAMPLES (% BY WEIGHT) X | IX | XII | XIII | XIV | XV |
|---|---|---|---|---|---|---|
| LAS | 4 | 6 | 5 | 12 | — | 6 |
| TEA.CnAS | — | — | — | — | 4 | 2 |
| $C_{14-15}.EO7$ | 2 | 2 | 3 | 5 | 8 | 3 |
| Cn-DEA | 2 | 2 | — | 3 | — | — |
| STPP | 18 | 16 | 22 | — | — | 10 |
| NTA | 2 | — | — | | 18 | 8 |
| Sodium Citrate | — | — | — | 15 | — | — |
| Zeolite A(1) | — | 8 | — | — | — | — |
| Sodium borate | 2 | — | 2 | — | — | 1 |
| KTS | 1 | 2 | 1 | 9 | 9 | 4 |
| Fatty acid $C_{16}$—$C_{22}$ | — | — | 1.5 | — | — | — |
| Ethanol | — | — | — | — | — | — |
| Glycerol | 3 | 4 | 5 | — | — | 3 |
| Polydimethylsiloxane(2) | 0.2 | — | — | — | — | — |
| Protease | 0.85 | 0.5 | 0.6 | — | — | 0.4 |
| DTPA | 0.2 | 0.2 | 0.2 | 0.2 | 0.4 | — |
| Polyacrylate M = 100.000 | 2 | — | 1 | — | — | 1 |
| DETPMP | — | — | 0.6 | — | — | 0.3 |
| Sil-I:DS 0.40 | 0.8 | — | 1.0 | — | — | 0.6 |
| Sil-IV:DS 0.15 | — | 0.6 | — | — | 0.7 | — |
| Sil-V:DS 0.55 | — | — | — | 0.4 | — | — |
| Miscellaneous incl. of water, aesthetics, brightener, neutralizers, etc. | | | balance to 100 | | | |

(1)Particle diameter 0.8–2.0 micrometer.
(2)Suds regulant.

We claim:

1. A liquid detergent composition capable of providing desirable textile benefits inclusive of softness, containing:

(a) from 5% to 70% by weight of a surface-active agent selected from the group of anionic, nonionic, amphoteric and zwitterionic surface-active agents and mixtures thereof;

(b) a liquid carrier; and (c) from 0.05% to 5% by weight of an organo-functional poly-di-$C_{1-4}$-alkyl siloxane textile treatment agent having the general formula:

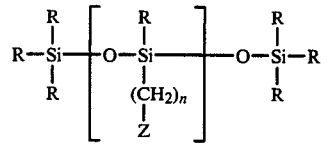

wherein

R=$C_{1-4}$-alkyl; n is an integer from 1 to 6;

Z is

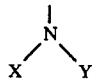

whereby X and Y are, selected independently, —H; —$C_{1-30}$-alkyl; —$C_6$-aryl; —$C_{5-6}$-cycloalkyl; —$C_{1-6}$—$NH_2$; —CO—R; with the proviso that the nitrogen can be quaternized such as to represent

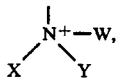

whereby W can be selected from X or Y; or

Z is

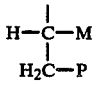

whereby P and M are —COOH; —CO—NR'$_2$; or $C_{1-2}$-alkyl;

with the further proviso that the degree of substitution, i.e., the molar proportion of silicones carrying a substituent other than a $C_{1-4}$-alkyl group to total silicones is in the range from 0.01 to 0.7.

2. The composition in accordance with claim 1 wherein the siloxane is amino-substituted.

3. The composition in accordance with claim 1 wherein the siloxane has a degree of substitution in the range from 0.02 to 0.3.

4. A substantially unbuilt liquid detergent composition capable of providing desirable textile benefits inclusive of softness containing:

(a) from 25% to 55% by weight of a surface-active agent selected from the group of anionic, nonionic, amphoteric and zwitterionic surface-active agents and mixtures thereof;

(b) a liquid carrier; and (c) from 0.05% to 5% by weight of an organo-functional poly-di-$C_{1-4}$-alkyl siloxane textile treatment agent having the general formula:

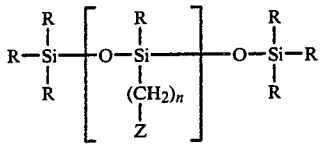

wherein

R=$C_{1-4}$-alkyl; n is an integer from 1 to 6; Z is

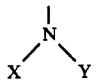

whereby X and Y are, selected independently, —H; —$C_{1-30}$-alkyl; —$C_6$-aryl; —$C_{5-6}$-cycloalkyl; —$C_{1-6}$—$NH_2$; —CO—R; with the proviso that the nitrogen can be quaternized such as to represent

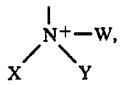

whereby W can be selected from X or Y; or

Z is

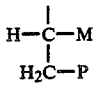

whereby P and M are —COOH; —CO—NR'$_2$; or $C_{1-2}$-alkyl;

with the further proviso that the degree of substitution, i.e., the molar proportion of silicones carrying a substituent other than a $C_{1-4}$-alkyl group to total silicones is in the range from 0.01 to 0.7.

5. The composition in accordance with claim 4 wherein the surface active agent is represented by a mixture of anionic and nonionic surface-active agents in a weight rstio bf anionic to nonionic in the range from 4:1 to 1:4.

6. The composition in accordance with claim 4 wherein the siloxane is amino-substituted.

7. The composition in accordance with claim 4 wherein the siloxane has a degree of substitution in the range from 0.02 to 0.3.

8. The composition in accordance with claim 4 wherein the siloxane is characterized as follows: n is 3 or 4, and X and Y are selected independently from: hydrogen; —$C_{1-4}$-alkyl; —$C_{5-6}$-cycloalkyl; and —$C_2$—$NH_2$.

9. The composition in accordance with claim 4 wherein the siloxane component is selected from:

(N-cyclohexylamino-4-amino-butyl-1) polydimethylsiloxane;

(Ethylene diamino-N-butyl-1) polydimethylsiloxane;

(N-dodecyl-4-amino-butyl-1) polydimethylsiloxane;

(4-(N,N-dimethyl ammonium)-butyl-1) polydimethylsiloxane;

(5-(tallow amide)-4carboxy-pentyl-1) polydimethylsiloxane.

10. A Liquid built detergent composition capable of providing desirable textile benefits inclusive of softness containing:

(a) from 5% to 25% by weight of a surface-active agent selected from the group of anionic, nonionic, amphoteric and zwitterionic surface-active agents and mixtures thereof;

(b) a liquid carrier;

(c) from 5% to 30% by weight of a detergent builder; and (d) from 0.05% to 5% by weight of an organo-functional poly-di $C_{1-4}$-alkyl siloxane textile treatment agent having the general formula

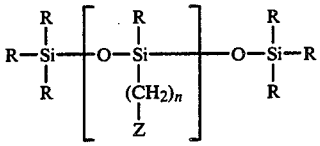

wherein

R=$C_{1-4}$; n is an integer from 1 to 6;

Z is

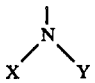

whereby X and Y are, selected indepedently, —H; —$C_{1-30}$-alkyl; —$C_6$-aryl; —$C_{5-6}$-cycloalkyl; —$C_{1-6}$—$NH_2$; —CO—R; with the proviso that the nitrogen can be quaternized such as to represent

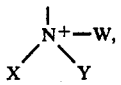

whereby W can be selected from X or Y; or

Z is

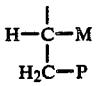

whereby P and M are —COOH; —CO—NR'$_2$; or $C_{1-2}$-alkyl;

with the further proviso that the degree of substitution, i.e., the molar proportion of silicones carrying a substituent other than a $C_{1-4}$-alkyl group to total silicones is in the range from 0.01 to 0.7.

11. The composition in accordance with claim 10 wherein the surface-active agent, which represents from 5% to 15% by weight, is represented by a mixture of anionic and nonionic surface-active agents, whereby the anionic species represents at least 20% (by weight) of the sum of anionic and nonionic surface-active agents.

12. The composition in accordance with claim 10 wherein the siloxane is amino-substituted.

13. The composition in accordance with claim 10 wherein the detergent builder represents from 12% to 25% by weight and is selected from the alkali-metal salts of polyphosphoric, citric and nitrilotriacetic acids and from ZEOLITE A, X and P having a particle diameter in the range from 0.1 to 4 micrometers.

14. The composition in accordance with claim 10 wherein the siloxane is characterized as follows: n is 3 or 4, and X and Y are selected independently from: hydrogen; —$C_{1-4}$-alkyl; —$C_{5-6}$-cycloalkyl; and —$C_{-2}$—$NH_2$.

15. The composition in accordance with claim 13 wherein the siloxane is selected from:

(N-cyclohexylamino-4-amino-butyl-1) polydimethylsiloxane;

(Ethylene diamino-N-butyl-1) polydimethylsiloxane;

(N-dodecyl-4-amino-butyl-1) polydimethylsiloxane;

(4-(N,N-dimethyl ammonium)-butyl-1) polydimethylsiloxane;

(5-(tallow amide)-4-carboxy-pentyl-1) polydimethylsiloxane.

* * * * *